US006634267B1

(12) United States Patent
Edens et al.

(10) Patent No.: US 6,634,267 B1
(45) Date of Patent: Oct. 21, 2003

(54) APPARATUS AND METHOD FOR REMOVING FASTENERS FROM DOCUMENTS

(75) Inventors: Bertus Karel Edens, Drachten (NL); Jan Jacobus Peter Remijnse, Meppel (NL)

(73) Assignee: Hadewe B.V., Drachten (NL)

( * ) Notice: Subject to any disclaimer, the term of this patent is extended or adjusted under 35 U.S.C. 154(b) by 0 days.

(21) Appl. No.: 09/168,065

(22) Filed: Oct. 8, 1998

(30) Foreign Application Priority Data

Oct. 8, 1997 (NL) ..... 1007234

(51) Int. Cl.[7] ..... B26D 1/00

(52) U.S. Cl. ..... 83/13; 83/686; 83/689; 30/358; 227/76; 227/63

(58) Field of Search ..... 83/686, 597, 689, 83/589, 542; 30/358; 227/76, 63

(56) References Cited

U.S. PATENT DOCUMENTS

| | | | | | |
|---|---|---|---|---|---|
| 3,762,258 | A | | 10/1973 | Bender | |
| 3,907,190 | A | * | 9/1975 | Mitsuhashi | 227/76 |
| 3,951,325 | A | * | 4/1976 | Mitsuhashi | 227/76 |
| 4,002,281 | A | * | 1/1977 | Hsu | 227/63 |
| 4,090,690 | A | | 5/1978 | Nitschneider et al. | |
| 4,114,793 | A | * | 9/1978 | Hsu | 227/76 |
| 4,171,121 | A | | 10/1979 | Nitschneider et al. | |
| 4,240,572 | A | | 12/1980 | Mitsuhashi | |
| 4,455,736 | A | | 6/1984 | Owen | |
| 4,494,426 | A | * | 1/1985 | Hartzell | 83/164 |
| 5,184,765 | A | * | 2/1993 | Orozco | 227/68 |

FOREIGN PATENT DOCUMENTS

| | | | |
|---|---|---|---|
| GB | 1025210 | | 4/1966 |
| JP | 8-126974 | * | 5/1996 |
| JP | 8126974 A | * | 5/1996 |
| JP | 08126974 | | 5/1996 |
| WO | WO94/17963 | | 8/1994 |

* cited by examiner

*Primary Examiner*—M. Rachuba
(74) *Attorney, Agent, or Firm*—Burns, Doane, Swecker & Mathis, LLP

(57) ABSTRACT

Apparatus for removing fasteners (13; 63; 113; 163) from documents (12; 62; 112; 162) with a perforator (5; 55; 105; 155; 205) for perforating documents (12; 62; 112; 162) in the area of the fastener to be removed, wherein the means for separating from the set of documents (12; 62; 112; 162) the fastener to be removed (13; 63; 113; 163) are constructed as a perforator for perforating the set of documents closely along the fastener to be removed. Also disclosed is a method for removing fasteners (13; 63; 113; 163), wherein the fastener (13; 63; 113; 163) is separated from the documents (12; 62; 112; 162) simply and fast in a single operation by perforating the set of documents (12; 62; 112; 162) closely along the fastener to be removed (13; 63; 113; 163).

20 Claims, 5 Drawing Sheets

APPARATUS AND METHOD FOR REMOVING FASTENERS FROM DOCUMENTS

FIELD AND BACKGROUND OF THE INVENTION

This invention relates to an apparatus and a method for removing fasteners from sets of documents.

Such an apparatus and such a method are known from U.S. Pat. No. 4,090,690.

It is noted that fasteners to be removed occur in a large variety, as in the form of staples with a bridge part and two bent legs, eyelets, metal plates which are bent over a corner of a document, and split pins which, in fitted condition, have a button resting against the set of documents.

The apparatus and method according to U.S. Pat. No. 4,090,690 constitute an improvement over the destaplers known heretofore, especially for rapidly removing large numbers of staples, because the laborious hooking of the fastener and then pulling it away relative to the documents have been replaced by a single operation, whereby at least a portion of the staple is pressed into the set of documents.

However, a drawback of this known destapler is that a staple, after it has been pressed into the set of documents, must still be separated from the documents. A further drawback of this known destapler, and the method to be practiced with it, is that the staples cannot be pressed through sets of documents of a thickness more than twice the wire thickness of the staple. Further, in many cases, the fastener tilts during compression, so that the maximum thickness of a set of documents through which a staple can be pressed is limited to a set of documents having a compressed thickness less than a single time the wire thickness of a fastener.

SUMMARY OF THE INVENTION

The object of the invention to provide a solution to the problem of removing fasteners very fast and reliably from sets of documents.

According to the present invention, this object is realized by providing an apparatus for removing fasteners from sets of documents, which comprises a perforator for perforating a set of documents closely along at least a portion of a fastener to be removed. A further embodiment of the invention for realizing this object is formed by a method for removing fasteners from sets of documents, wherein the set of documents is perforated along at least a portion of the fastener to be removed.

By perforating the set of documents from which the fastener is to be removed, a passage right through the set of documents is created in a simple and reliable manner, so that the fastener can be simply removed. The perforation provided in the set of documents when removing the staple may be of a very minor size and does not constitute any essentially greater damage of the documents than the weakening of the documents and the creases and dog-ears formed in the conventional removal of fasteners. Generally, next to the perforation, sufficient space is left for fastening the documents to each other again, if desired. In general, it is advantageous if the perforation extends as closely as possible alongside the staple. Perforating directly alongside the staple is most ideal, but it is also possible to select distances between the position of this fastener to be removed and the most proximal edge portion of the perforation to be less than 1, 2, 3 mm or slightly more.

Hereinafter, further objects, embodiments, effects and advantages of the invention are described and explained on the basis of a presently most preferred exemplary embodiment and a few variants, with reference to the drawing.

DETAILED DESCRIPTION

The following description is based on examples intended for removing staples consisting of wire material forming a bridge part and bent legs, projecting from that bridge part. However, it will be clear to those skilled in the art that adapted embodiments can also be used for removing other types of permanent fasteners provided through documents or embracing them.

Figure 1:
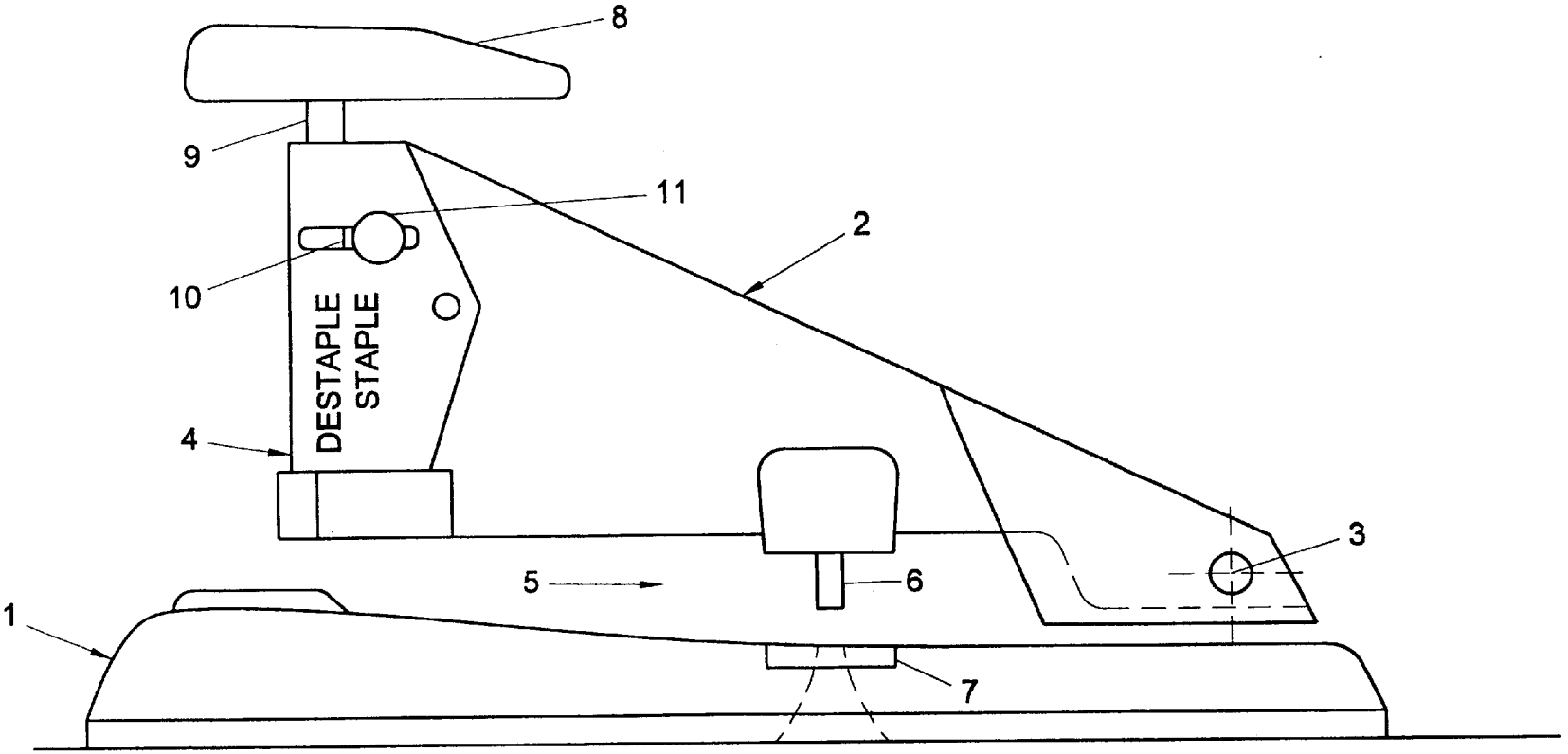
FIG. 1 is a side elevation of a destapler according to the invention.

FIG. 1 shows, by way of example, a stapler based on a commercially available stapler of the make Rapid, type "2", manufactured by Isaberg AB of Hestra, Sweden, with an underframe 1, a reciprocable supporting arm 2 which can be pivoted back and forth relative to the underframe 1 about an axis 3. Naturally, as a basic structure, any other stapler or a specially constructed stapling machine having a sufficiently stable construction can be used.

In a manner which is known and therefore not further described here, the supporting arm 2 is provided with a mechanism 4 for providing staples through sets of documents.

The apparatus further comprises a perforator 5 with a die or punch 6 and a die plate 7. The supporting arm 2 further carries a punch member 6 of perforator 5 and the underframe 1 carries the die plate member of the perforator 5.

The mechanism 4 for providing staples has an operating knob 8 which is mounted on a transmission slide 9. In conventional use, upon depression of the operating knob 8, the slide 9 is moved down and a staple is shifted off a row of staples and pressed into a set of documents which is held between the supporting arm 2 and the underframe 1. To block the transmission slide 9 in its upper position, the mechanism 4 for providing staples comprises a blocking pawl 10 which is operable by a sliding knob 11. When the sliding knob 11 is in the "STAPLE" position, the transmission slide 9 is released, allowing it to reciprocate in a conventional manner for providing staples. When the sliding knob 11 is in the "DESTAPLE" position, the transmission slide 9 is blocked, allowing the operating knob 8 to be pressed upon for perforating (piercing) paper in the area of a staple without the stapling mechanism 4 dispensing and placing a new staple.

Figure 2:
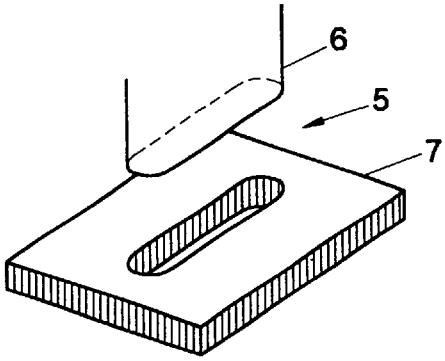
FIG. 2 is a cut-off, perspective representation of a punch-die plate combination for use in an apparatus according to FIG. 1.

The construction and the operation of the perforator is described in more detail with reference to FIGS. 2 and 3, which represent the embodiment of perforator 5 that is presently preferred most.

Figure 3:
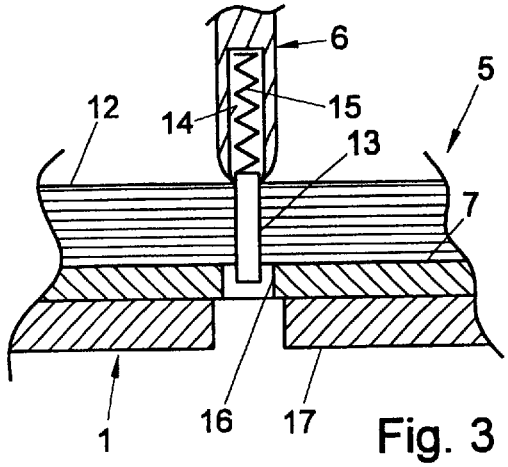
FIG. 3 is a sectional side elevation of the punch-die plate combination according to FIG. 2.

In FIG. 3, the perforator 5 is represented with a set of documents 12, fastened to each other by a staple 13, placed between the punch 6 and the die plate 7. The punch 6 forms a projection for perforating the set of documents 12 and, as the set of documents is being perforated, for engaging, through the perforation provided, the staple 13 to be removed, which is thereby pressed, ahead of the punch 6, through the Set of documents 12.

More particularly, starting from the situation shown in FIG. 3, first the punch 6 is moved down, causing the set of documents 12 to be perforated and portions of the documents in which the staple 13 is provided to be cut loose from surrounding material. In the process, the staple 13 and any adjacent material of the set of documents 12 are temporarily received in a recess 14 in the punch 6, while a schematically indicated resilient element 15 engages the staple and thereby exerts a pressure force on the staple 13 in the direction of movement of the punch 6. As soon as the perforation of the set of documents 12 is complete and the staple 13 has been cut loose completely from the documents 12, the staple 13 is ejected by the resilient element 15 through an opening 16 in the die plate 7 and a portion 17 of the subjacent underframe 1.

It is also possible to make the recess 14 in the punch 6 considerably less deep, for instance just deep enough to keep the staple 13 in front of the punch 6. In that case, during the perforation of the set of documents 12, the staple is pressed ahead of the punch 6, which requires a higher punching force but enables a simple construction of the punch and limits the risk of the staple getting stuck in the recess in the punch.

The die plate 7 has an elongate opening for receiving and passing a staple to be removed. This provides the advantage that the staple can be punched loose and separated in a single movement. It is also possible, however, to have a punch run against a counterplate and, for instance, to eject the staple by moving the punch together with the set of documents away from the counterplate.

The opening 16 in the die plate 7, located opposite the punch 6, further facilitates accurate positioning of the staple 13, in that the opening 16 in the die plate 7 further functions as a positioning recess into which falls the staple portion remote from the punch, projecting from the set of documents 12. When positioning the set of documents 12, it is thus clearly felt whether or not the staple 13 is properly positioned. Furthermore, arresting the staple in the opening 16 facilitates keeping the staple 13 exactly in its position opposite the punch 6 during punching.

For an accurate positioning of the staple 13, it is further advantageous that the opening 16 in the die plate 7 is shaped to correspond with the cross section of the punch 6. If the portion of the staple 13 remote from the punch 6, projecting outside the documents 12, falls into the opening 16, the staple is thus reliably positioned in the punching path of the punch 6 at all times.

Figure 4:
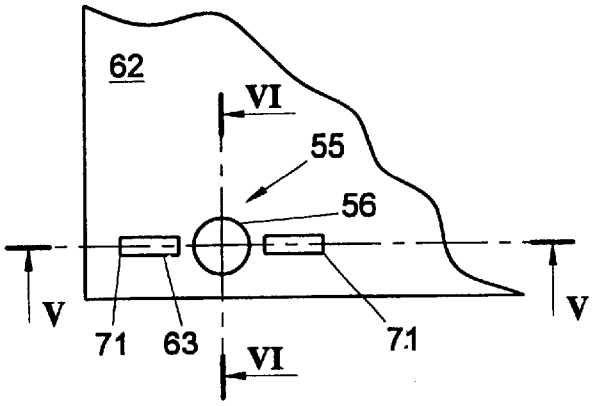
FIG. 4 is a cut-off top plan view of a punch of a destapler according to a further exemplary embodiment in a condition of use above a staple in a set of documents.
Figure 5:
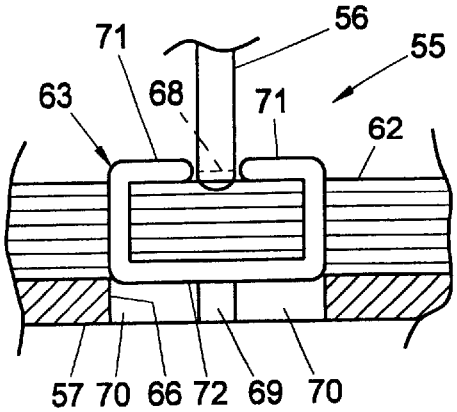
FIG. 5 is a sectional side elevation along the line V–V in FIG. 4.
Figure 6:
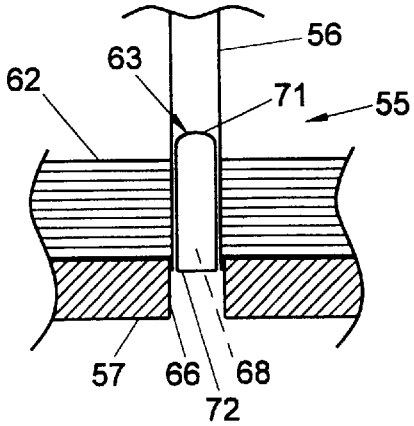
FIG. 6 is a sectional side elevation along the line VI–VI in FIG. 4, albeit that the punch is shown in a condition pressed through the set of documents.

FIGS. 4–6 represent an alternative embodiment of a perforator 55 for a destapler according to the invention, each time in combination with a set of documents 62 and a staple 63 to be removed therefrom. The perforator 55 has a punch 56 and a die plate 57 with an opening 66. The punch 56 has an end face 68 which forms a profile in the form of a channel-shaped recess, traversing the end face, for receiving a portion of a staple 63. A central portion 69 of the opening 66 of the die plate 57 corresponds to the shape of the cross section of the punch 56. Peripheral portions 70 of the opening 66 of the die plate 57 on opposite sides of the central portion 69 are open when the punch 66 is in a position projecting into the die plate 57. Other profiles, such as a serration or a pair of projecting parts, may also be used to keep the staple opposite the end face during removal.

In the use of such a perforator 55, the perforation is provided by the punch 56 between arms 71 of the staple 63. Each time the punch 56 has been pressed through the set of documents 62, the punch 56 engages a bridge portion 72 of the staple 63. This stage of the process of removing a staple is shown in FIG. 6. Finally, the punch 56 presses the staple 63 out of the set of documents 62, causing the arms 71 to bend slightly to a position transverse to the plane in which the set of documents 62 extends. The channel-shaped recess extending transversely across the end face of the punch 56 here ensures that the bridge portion 72 of the staple 63, as it is being pressed away, remains opposite the punch 56 and does not slide laterally off the end face of the punch 56. A particular advantage of this perforator is that it does not need to be oriented relative to the staple to be removed, at least when the opening in the die plate allows the passage of staples regardless of the orientation in the plane of the set of documents.

Since the central portion 69 of the opening 66 in the die plate 67 is wider than the peripheral portions 70 of that opening 66, a punch 56 can be used which is wider than the staple 63, while the staple 63, owing to the narrow peripheral portion 70, is accurately centered, especially in its transverse direction, relative to the punch 56, and the punch 56 reliably engages centrally of the staple 63. Further, the narrow design of the outer portions 70 of the opening 66 limits bulging of the documents.

Figure 7:
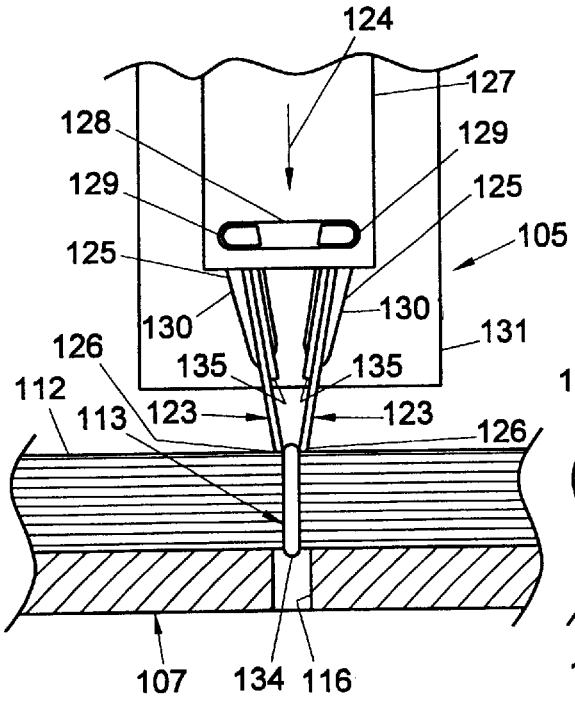
FIG. 7 is a sectional cut-off side elevation of a destapler according to a still further exemplary embodiment in a condition of use just before the perforation of a set of documents.
Figure 8:
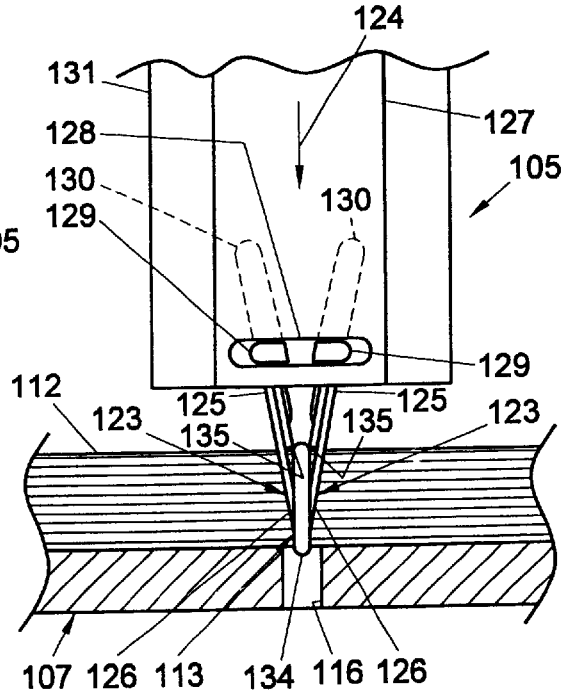
FIG. 8 is an elevation similar to FIG. 7, in a condition of use in which the set of documents has just been perforated.
Figure 9:
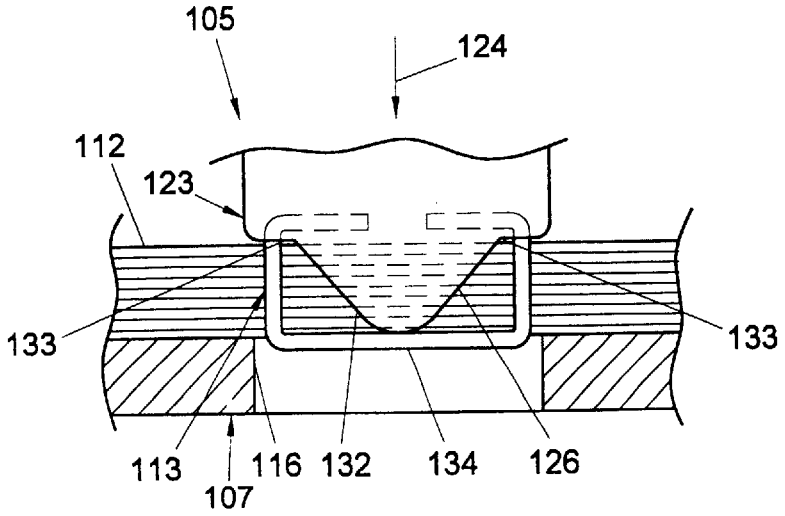
FIG. 9 is a sectional cut-off side elevation transverse to the elevation according to FIG. 8.

FIGS. 7–9 represent another alternative embodiment of the perforator 105. This perforator 105 is provided with knives 123 for cutting through a set of documents 112 along a staple 113 to be removed. By cutting along a staple 113 to be removed, and removing the cut-loose staple 113 from the set of documents 112, the amount of material that is removed from the documents 112 is kept very low. If cutting is limited to a single cut along the staple, the amount of cut-loose material can even be limited to substantially zero.

According to the present example, however, two knives 123 are used, which are suspended to cut on opposite sides along a staple 113 to be removed. Thus, the staple 113 can be cut loose highly reliably.

The knives 123 are suspended so as to converge in a cutting direction (arrow 124), causing them, during cutting, to push towards the staple 113 and slide along the staple 113. As a result, cutting proceeds very closely along the staple 113 and cuts are obtained which, practically speaking, communicate with the holes provided in the set of documents 112 when the staple 113 was applied, so that the staple 113 is cut loose completely, or substantially completely, from the set of documents 112.

The knives 123 have fixed ends 125 which are suspended so as to be movable relative to each other, transversely to the cutting direction 124 and the cutting edges 126. To that end, a knife holder member 127 which is reciprocable along with the knives 123 in the cutting direction 124, is provided with a slot 128, transverse to the cutting direction, in which slot guide slides 129 carrying the fixed ends 125 of the knives 123 can be reciprocated. Due to the displaceability of the fixed ends, the angle between the knives 123 can be gradually reduced during the movement in the cutting direction 124, so that, even when perforating thicker packs of documents 112, the distance between the cuts on the side of the packs of documents 112 proximal to the knives 123 is limited, and tearing of the documents between the cuts is prevented.

The guide slides 129 are further guided in slots 130 in a fixed portion 131 of the knife holder. These slots 130 converge in the shape of a V in the cutting direction 124, so that during the performance of a perforation stroke, an imposed movement of the fixed ends 125 of the knives is obtained, with the mutual distance between them decreasing according as the knives 123 move further in the cutting direction 124. As a result, the knives 123 always move substantially in the direction in which they project, so that tearing of documents is prevented.

For limiting damage to the set of documents 112, it is further advantageous that the knives 123 are of flexible design, so that they can adjust to the documents 112. This further provides the advantage that the knives 123, from the fixed ends 125, can be pressed obliquely against a side of a staple 113, but alongside the staple 113 can extend virtually parallel to the legs of the staple. This enables reliably making cuts that extend very closely along the staple throughout their height.

As appears from FIG. 9, the cutting edges 126 each have a central portion 132 and outer portions 133, the central portion 132 projecting relative to the outer portions 133 in the cutting direction 124. Such a design of the cutting edge 126 limits the cutting forces. In combination with the position of the knives 123 projecting obliquely towards the staple 113, this design of the cutting edge 126 further makes it possible for the central portion 132 of the cutting edge 126 to cut inside the space enclosed by the staple 113, while the outer portions 133 of the cutting edge 126 are guided by the legs of the staple 113, extending through the documents 112.

Optionally, it is possible to further use the central portion 132 of the cutting edge 126, while engaging the bridge portion 124 of the staple 113, to press the staple from the documents 112. However, for displacing the staple 113, it is preferred to use stop surfaces 135 facing in the cutting direction 124 for carrying along a staple 113 to be removed. This prevents contact between the cutting edge 126 and the typically steel staple 113, so that the cutting edge 126 remains sharp longer.

According to the example shown, the stop surfaces 135 of the knives 123 engage the portions of the staple 113 that are proximal to the knives 123 prior to cutting. It is also possible, however, to arrange for such stop surfaces carried by the knives to engage another portion of the staple, such as the bridge portion.

In the perforator 105 according to this example, too, the documents 112 are supported in the area of the staple 113 by a die plate 107 with an opening 116, through which opening 116 the staple 113 passes after being separated from the documents 112.

Figure 10:
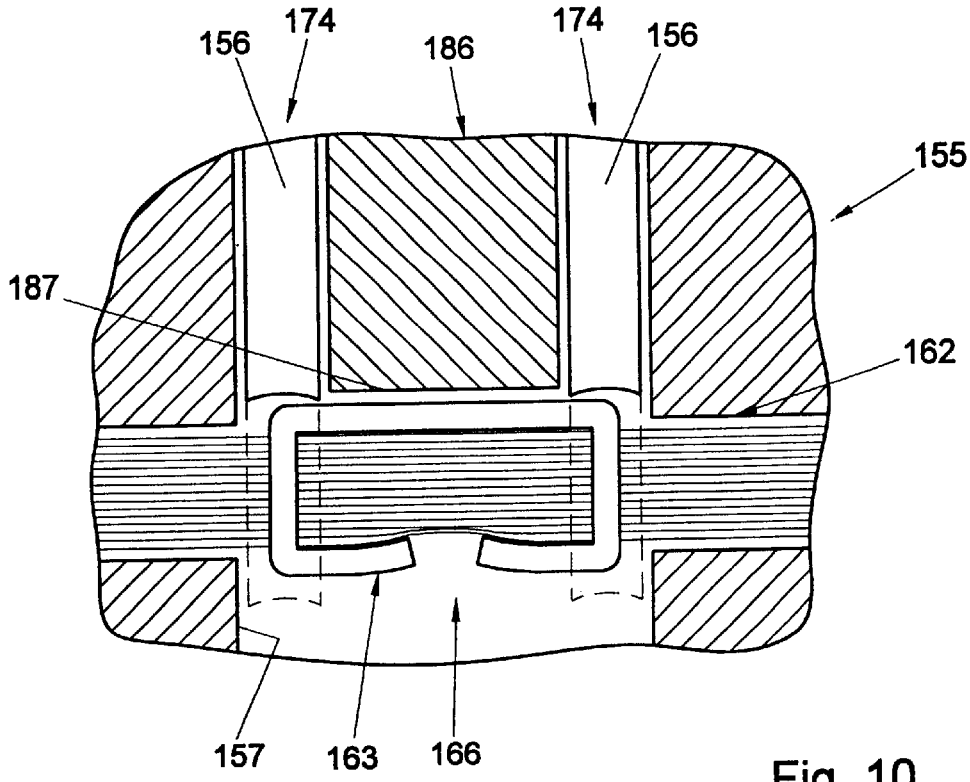
FIG. 10 is a sectional cut-off side elevation of a destapler according to a yet further exemplary embodiment in a condition of use just before the perforation of a set of documents.

FIG. 10 shows a still further exemplary embodiment of the perforator 155 for perforating a set of documents to remove a staple therefrom. The perforator 155 has two punches 156 of a cross section slightly greater than the cross section of the wire material of which the staples to be removed consist. Located opposite the punch dies 156 is a die plate 157 with an opening 166, in which the dies 156 fit with a very minor lateral clearance, and through which fit portions of the staple 163. The punch dies 156 are represented in solid lines in a position immediately prior to the cutting of the staple and the perforation of the set of documents 162. Broken lines indicate the punch dies 156 in an extreme projecting position. To remove a staple 163, the punch dies 156 are displaced from the starting position in the cutting direction towards the extreme projecting position. This causes the staple to be cut first adjacent two corner points between portions extending through the set of documents and portions extending along the set of documents. Then, two cut-loose portions of the staple 163, including the portions extending through the set of documents, are pressed away, ahead of the punch dies 156, out of the set of documents 162, while the punch dies 156 perforate the set of documents 162. These cut-loose portions leave the set of documents 162 through-the opening 166 in the die plate 157.

Since the punch dies 156 have a slightly greater diameter than the wire of the staple 163, the portions of the staple 163 extending through the set of documents 162 are reliably cut loose and propelled.

To accurately position the punch dies 156 relative to the staple to be cut, on the side of the documents 162 where the punch dies 156 are located in the initial position, a template 186 with a recess 187 is pressed against the set 162. The staple then falls into the recess 187, so that the position of the staple 163 with respect to the punch dies 156 is defined. The end faces of the punch dies 156 are provided with a profile ensuring that the out-off portions of the staple are held in front of those end faces during the press-away operation. That profile may be designed, for instance, as a concave surface.

The residual portion of the staple 163 on the side of the template 186 can be removed in various ways, for instance by a blower or a stiff brush.

Figure 11:
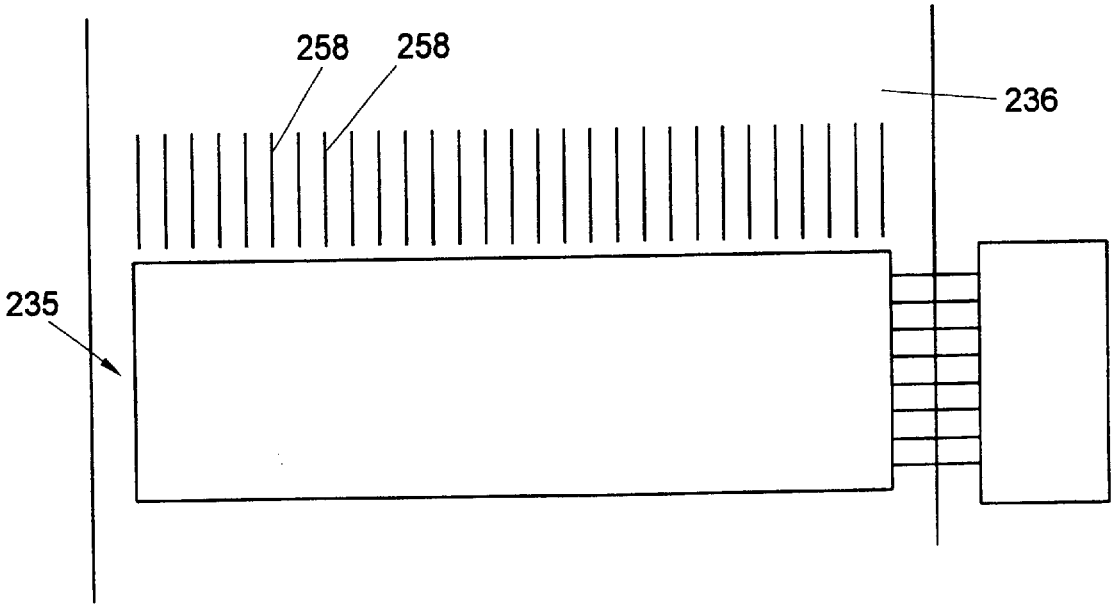
FIG. 11 is a schematic representation of a sensor for detecting the position and the orientation of a staple.
Figure 12:
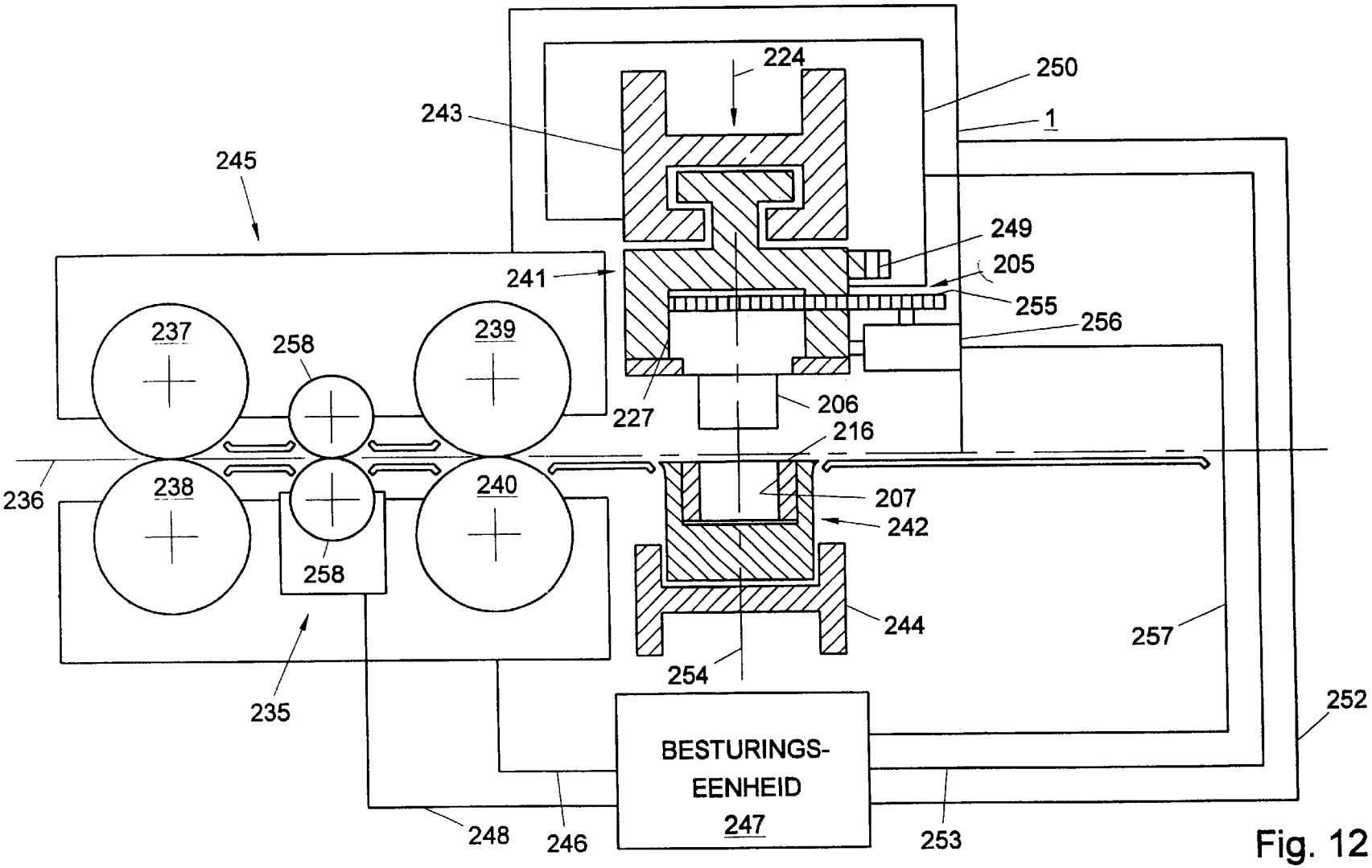
FIG. 12 is a cutaway side elevation of a destapler with automatic positioning of the destapling perforator.

FIGS. 11 and 12 show an apparatus according to an embodiment of the invention which is presently preferred most as to its general construction. This apparatus comprises a sensor 235 for detecting the position of a staple to be removed, and transport means for displacing a set of documents and the perforator 205 relative to each other, such that the perforator 205 is aligned with the detected position of the staple in the set of documents for providing the perforation in the area of the priorly detected position of the staple.

The transport means formed by a transport path 236, along which are arranged driven and mutually coupled rollers 260 and carriages 241, 242 which are mobile along rails 243, 244, transversely to the transport path 236.

Prior to the removal of a staple, the set of documents is scanned for detecting the position of the staple to be removed. Then the documents are displaced along transport path 236 and the perforator 205 is displaced transversely to the transport path until they are displaced relative to each other, such that the perforator is disposed opposite the staple to be removed. The documents can now be reliably perforated in the area of the staple for removing the staple.

The drive unit 245 for driving the transport rollers 237, 238, 239, 240 is connected to a control unit 247 via a line 246. Further, the sensor 235 is connected to the control unit 247 via a line 248.

The position of the staple is determined on the basis of the displacement of the documents along the transport path 236 prior to the detection of the staple and on the basis of the position in the direction transverse to the transport path, where the staple is detected. Then the document is displaced over a fixed distance along the transport path 236 and the carriages 241, 242 are displaced along the rails 243, 244 into a position corresponding to the position of the staple in transverse direction relative to the transport path 236.

The upper carriage 241 is coupled to a toothed belt 249 which passes over gears in end parts 250 on opposite sides of the rail 243. The lower carriage 242 is clamped with some friction in the rail 244. For displacing the carriages 241, 242 equally, first the punch 206 of the perforator 205 is set in a position in which it projects into the opening 216 in the die plate 207. To that end, the entire rail 249, including the end parts 250, is moved down relative to the frame 251 of the apparatus. The drive for this can be designed in a manner known per se, for instance with electromagnets which may or may not be enhanced by levers or the like, and is therefore not further described. With the punch 206 in this position, the carriage 241 is displaced and the carriage 242 is carried along.

For operating the perforator 205, the control unit 247 is coupled via a line 252 to the drive (not shown) of the perforator, which drive is mounted on the frame 251. To control the position of the carriages 241, 242 in transverse direction, the control unit 247 is coupled via a line 253 to the drive (not shown) of the toothed belt 249.

To avoid friction during the displacement of the carriage 242, it may optionally be provided with friction members engaging the rail 244, which can be set out of operation.

It is possible that the position of the staple is such that the set of documents is already disposed between the punch 206 and the die plate 207 before the staple has reached the sensor 235 and the perforator 205 can be set in the proper position in transverse direction. For such situations, it may be provided that the documents are first transported back automatically to clear the area of the perforator 205 and then, after the perforator 205 is set in the desired position in transverse direction, to transport the documents along the transport path 236, such that the staple is brought opposite the perforator 205. Renewed detection of the staple as it passes the sensor 235 again may then be utilized for the accurate control of the transport of the documents. If the documents are introduced with the staple in a leading portion, return transport of the documents will generally not be necessary.

The perforator 205 is additionally suspended for pivotal motion about an axis 254 in the cutting direction 224. During the scanning of the set of documents, further the orientation of the staple to be removed is detected and subsequently the perforator 205 is moved relative to the set of documents into an orientation corresponding to the orientation of the staple. To that end, the punch 206 and the die plate 207 are suspended for pivotal motion about said axis 254, and the punch is mounted in a rotatably suspended carrier 227 which is coupled by a toothed belt 255 to a gear on an output shaft of a stepping motor 256. The stepping motor is connected to the control unit 247 via a line 257.

The sensor 235 for detecting the position of the staple is designed as a conductivity sensor. By scanning at which points a set of documents transmits a voltage, it can be determined in a simple manner where the typically metal staple is located.

The depicted sensor 235 comprises a number of detectors 258 in the form of scanning wheels, distributed in a direction transverse to the direction of transport of the documents. The scanning wheels 258 are represented schematically in FIG. 11, and for clarity only two of them are designated by reference numerals. The voltage is applied to the upper scanning wheels 256. Failure of the voltage on lower scanning wheels marks the arrival of a leading edge of a set of documents at the location of the sensor 235. Thereupon, voltage on one or a few of the lower wheels 258 indicates that a staple is located between those wheels. By monitoring which of the lower wheels 258 are subject to a voltage, and registering the position of the documents in the direction of the transport path, the position and the orientation of the staple or staples can be accurately determined.

Then, as regards the position of the staple in the direction of transport, it is sufficient to transport the documents over a fixed distance to the perforator 205 to bring the staple exactly to the location of the perforator 205.

Within the framework of the proposed concept, naturally many variations are conceivable. Thus, the perforator may, for instance, be mounted in a fixed position with respect to a conveyor, while the documents are displaceable over the conveyor in the x- and y-directions. Such conveyors are described in U.S. Pat. Nos. 5,222,585 and 5,415,266.

For determining the position of the staple, too, various alternative sensors are possible, based on principles for metal detection, known per se, such as a combination of a magnetizer for magnetizing the staple and a sensor sensitive to magnetism, or a combination of an antenna for generating an electromagnetic field and facilities for detecting energy locally absorbed from the field generated. Also various mechanical sensors can be used, such as a ridge for engagement of a staple butting against that ridge, or a thickness sensor. Further, the detection can be carried out in an optical manner, as by the detection of a dispersion characteristic of a metal staple and/or reflection of light of one or more wavelengths, while the light source may be a laser unit producing a line-shaped or planar light beam which is moved along the documents. Such scanners are known per se. Another example of a suitable sensor for determining the position of the staple is a pressure-sensitive film which is pressed against the set of documents by a flat support. Such a film is commercially offered by, for instance, Tekscan, South Boston, Mass., United States.

We claim:

1. A method for removing a fastener from a set of stacked documents mutually fastened to each other by the fastener, comprising perforating said set of documents closely along at least a portion of the fastener to be removed.

2. A method according to claim 1, wherein the perforation is carried out with a die plate and wherein the fastener is removed via an opening in the die plate.

3. A method according to claim 1, wherein the perforation is provided by a punch between arms of the fastener and wherein, after the punch is pressed through the set of documents, the punch engages a portion of the fastener on the side of the set of documents remote from the punch.

4. A method according to claim 1, wherein along the fastener to be removed, at least one line-shaped incision is provided and the cut-loose fastener is removed from the set of documents.

5. A method according to claim 4, wherein the incision is formed by a knife which further engages the fastener to be removed and carried it along.

6. A method according to claim 1, further comprising, prior to removing the fastener, scanning the set of documents for detecting the position of the fastener to be removed and subsequently displacing the set of documents and the perforator relative to each other until the perforator is disposed opposite the fastener to be removed.

7. A method according to claim 6, wherein during the scanning of the set of documents, further the orientation of the fastener to be removed is detected and subsequently the perforator is moved relative to the set of documents into an orientation corresponding to the orientation of the fastener.

8. A method for removing a fastener from a set of documents fastened together in a stack by the fastener, comprising:

positioning the set of documents fastened together by the fastener between a punch and a die plate;

moving the punch toward the set of documents to perforate documents in the set in an area at least partially surrounding the fastener to cut loose portions of the documents in which the fastener is provided and separate the fastener from remaining portions of the documents.

9. The method according to claim 8, wherein the punch includes a recess which receives the fastener during perforation of the documents.

10. The method according to claim 8, wherein the die plate includes an elongate opening which receives the fastener which has been separated.

11. The method according to claim 8, wherein the set of documents fastened together by the fastener is positioned between a pair of punches and the die plate, with the pair of punches being moved towards the die plate.

12. The method according to claim 8, wherein the die plate includes a positioning recess, the set of documents being positioned between the punch and the die plate such that the fastener is positioned in the positioning recess.

13. The method according to claim 12, wherein the positioning recess is an elongate opening in the die plate.

14. The method according to claim 7, wherein the punch has an end face configured as a channel-shaped recess which receives a portion of the fastener during movement of the punch.

15. A method for removing a fastener from a set of documents fastened together in a stack by the fastener, comprising:

operating a perforating element engaging the set of documents in an area at least partially surrounding the fastener to perforate the documents in the area at least partially surrounding the fastener to separate a portion of each document in which the fastener is provided from a remaining portion of each document.

16. The method according to claim 15, wherein the perforating element is a punch that is moved towards a die plate, the punch including a recess which receives the fastener during perforation of the documents.

17. The method according to claim 16, wherein the die plate includes an elongate opening which receives the fastener which has been separated.

18. The method according to claim 16, wherein the die plate includes a positioning recess, the set of documents being positioned between the punch and the die plate such that the fastener is positioned in the positioning recess.

19. The method according to claim 15, wherein the perforating element comprises at least one knife which are moved towards a die plate.

20. The method according to claim 15, wherein the perforating element includes a pair of punches which are moved towards a die plate.

* * * * *